US012662842B2

(12) United States Patent
Wiens

(10) Patent No.: US 12,662,842 B2
(45) Date of Patent: Jun. 23, 2026

(54) BURIAL VAULT ASSEMBLY

(71) Applicant: Doric Products, Inc., Marshall, IL (US)

(72) Inventor: James Wiens, Marshall, IL (US)

(73) Assignee: Doric Products, Inc., Marshall, IL (US)

( * ) Notice: Subject to any disclaimer, the term of this patent is extended or adjusted under 35 U.S.C. 154(b) by 0 days.

(21) Appl. No.: 18/933,234

(22) Filed: Oct. 31, 2024

(65) Prior Publication Data

US 2025/0137279 A1 May 1, 2025

Related U.S. Application Data

(60) Provisional application No. 63/595,112, filed on Nov. 1, 2023.

(51) Int. Cl.
*E04H 13/00* (2006.01)

(52) U.S. Cl.
CPC ..... *E04H 13/00* (2013.01)

(58) Field of Classification Search
CPC .... E04H 13/00; A61G 17/001; A61G 17/0136
USPC ..... 27/35; 52/135, 139, 141, 142
See application file for complete search history.

(56) References Cited

U.S. PATENT DOCUMENTS 1,174,514 A * 3/1916 Millhouse ..... E04H 13/00 52/139
2,940,156 A * 6/1960 Cook ..... E04H 13/00 D99/7
3,208,186 A 9/1965 Fulton et al.
3,208,188 A * 9/1965 Fulton ..... A61G 17/00 27/35
3,545,055 A * 12/1970 Pare ..... A61G 17/0136 27/7
3,810,282 A * 5/1974 Doggett ..... A61G 17/0166 27/35
3,868,799 A * 3/1975 Hayward ..... E04H 13/00 27/35
RE29,114 E * 1/1977 McQuestion ..... A61G 17/007 27/35
4,143,494 A 3/1979 Abbate
4,237,590 A * 12/1980 Work ..... A61G 17/028 27/DIG. 1
4,265,006 A * 5/1981 Angermann ..... A61G 17/0136 27/14
4,288,952 A * 9/1981 Work ..... E04H 13/00 27/35
4,372,018 A * 2/1983 Miller, IV ..... A61G 17/00 27/35
5,471,718 A * 12/1995 Harrill ..... A61G 17/0136 27/14

(Continued)

FOREIGN PATENT DOCUMENTS

FR 3114338 A1 * 3/2022 ..... E04H 13/00

*Primary Examiner* — William L Miller
(74) *Attorney, Agent, or Firm* — Barnes & Thornburg

(57) ABSTRACT

A burial vault assembly includes a liner, a jacket, and a jacket cap. The liner is formed to define an interior region. The jacket is arranged around the liner and is configured to be exposed to earth surrounding the burial vault assembly. The jacket cap extends around at least a portion of the jacket and is coupled with the liner to couple the liner with the jacket.

19 Claims, 4 Drawing Sheets

(56) References Cited

U.S. PATENT DOCUMENTS

| | | | | |
|---|---|---|---|---|
| 5,548,880 | A * | 8/1996 | Harb | A61G 17/041 27/26 |
| 5,568,677 | A | 10/1996 | Tobin | |
| 5,960,524 | A | 10/1999 | Darby et al. | |
| 6,345,422 | B1 | 2/2002 | Darby | |
| 6,453,626 | B1 | 9/2002 | Weilein et al. | |
| 6,484,457 | B1 * | 11/2002 | Dudek | E04H 13/00 52/141 |
| 6,901,640 | B2 * | 6/2005 | Sevey | A61G 17/036 27/35 |
| 8,028,384 | B2 * | 10/2011 | Norder | E04H 13/00 27/35 |
| 8,096,028 | B2 | 1/2012 | Bates | |
| 8,881,351 | B2 * | 11/2014 | Schwab | A61G 17/0136 52/141 |
| 2003/0182779 | A1 * | 10/2003 | Sevey | A61G 17/042 27/19 |
| 2010/0242379 | A1 * | 9/2010 | Norder | E04H 13/00 52/742.14 |
| 2014/0208553 | A1 * | 7/2014 | Schwab | A61G 17/0136 27/7 |

* cited by examiner

BURIAL VAULT ASSEMBLY

CROSS REFERENCE TO RELATED APPLICATIONS

This application claims priority to and the benefit of U.S. Provisional Patent Application No. 63/595,112, filed 1 Nov. 2023, the disclosure of which is now expressly incorporated herein by reference.

FIELD OF THE DISCLOSURE

The present disclosure relates generally to burial vaults, and more specifically to multi-piece polymeric burial vault assemblies.

BACKGROUND

Funerary boxes, such as caskets or coffins, may be constructed of wood or other material and buried in the ground for the burial of the deceased. Funerary boxes that are buried directly in the ground may decompose and form sink holes and/or allow earth and moisture to enter the funerary box. Traditionally, funerary boxes have been placed in concrete burial vaults to prevent sink holes and to protect the funerary box from the environment in the earth. However, concrete burial vaults may be heavy and difficult to store, transport, and use. Concrete, if not lined, is porous and may allow moisture to penetrate to the funerary box. As such, there remains a desire to provide light-weight and water impermeable burial vaults to protect funerary boxes.

SUMMARY

The present disclosure may comprise one or more of the following features and combinations thereof.

According to an aspect of the present disclosure, a burial vault assembly adapted to be arranged around a funerary box includes a base formed to define an interior region adapted to receive the funerary box therein and a cover. The base includes an inner liner, an outer jacket, and a first jacket cap. The inner liner includes a side wall formed to define the interior region, a rim extending upwardly from the side wall, and a flange. The flange extends from the rim away from the interior region of the side wall. The outer jacket is arranged around the inner liner and configured to be exposed to earth surrounding the burial vault assembly.

The first jacket cap extends around a perimeter edge of the outer jacket. The first jacket cap includes a first brim and a first mount wall. The first brim defines a jacket-receiving channel that receives at least a portion of the perimeter edge of the outer jacket therein. The first mount wall extends away from the first brim toward the side wall of the inner liner and is coupled with the flange of the inner liner to couple the inner liner with the outer jacket.

The cover is configured to be supported on the base to close the interior region and block ingress of moisture and the earth into the interior region. The cover includes a cover liner, a cover jacket, and a second jacket cap. The cover liner is supported by the inner liner of the base to close access into the interior region. The cover jacket is arranged around the cover liner and configured to be exposed to the earth. The second jacket cap extends around a perimeter edge of the cover jacket.

The second jacket cap includes a second brim and a second mount wall. The second brim defines a second jacket-receiving channel that receives at least a portion of the perimeter edge of the cover jacket therein. The second mount wall extends away from the second brim toward the cover liner and is coupled with the cover liner to couple the cover liner with the cover jacket.

In some embodiments, the first jacket cap further includes a first support lip. The first support lip extends away from the first mount wall and the cover and toward a floor of the outer jacket to reinforce a strength of the first jacket cap. In some embodiments, the first support lip is spaced apart from the side wall of the inner liner.

In some embodiments, the first brim of the first jacket cap includes an external wall, an interior wall, and a join wall. The external wall is exposed to the earth surrounding the burial vault assembly. The interior wall is spaced apart from the external wall and connected with the first mount wall. The join wall extends between and interconnects the external wall and the interior wall. In some embodiments, the first mount wall and the interior wall cooperate to define a groove that extends away from the join wall.

In some embodiments, the outer jacket includes a first end wall, a second end wall spaced apart from the first end wall, a first side wall extending between and interconnecting the first end wall and the second end wall, and a second side wall spaced apart from the first side wall and extending between and interconnecting the first end wall and the second end wall. The first end wall, the second end wall, the first side wall, and the second side wall are integrally formed as a one-piece, single component.

In some embodiments, the first end wall, the second end wall, the first side wall, the second side wall define an entirety of the perimeter edge of the outer jacket. The first jacket cap is an integral one-piece, single component that extends continuously around the entirety of the perimeter of the outer jacket.

In some embodiments, the inner liner includes a floor coupled with the side wall to close an end of the interior region. The outer jacket includes a floor extending between and interconnecting the first end wall, the second end wall, the first side wall, and the second side wall. The floor of the inner liner is supported by the floor of the outer jacket.

In some embodiments, the burial vault assembly further includes a first layer of adhesive and a second layer of adhesive. The first layer of adhesive is located between the first brim and the outer jacket to couple the first jacket cap with the outer jacket. The second layer of adhesive is located between the first mount wall and the flange to couple the inner liner with the first jacket cap.

According to another aspect of the present disclosure, a burial vault assembly includes a liner, a jacket, and a jacket cap. The liner has a side wall formed to define an interior region, a rim that extends from the side wall, and a flange that extends from the rim away from the interior region of the side wall. The jacket is arranged around the liner and configured to be exposed to earth surrounding the burial vault assembly. The jacket cap includes a brim and a mount wall. The brim defines a jacket-receiving channel that receives at least a portion of a perimeter edge of the jacket therein. The mount wall extends away from the brim toward the side wall of the liner and is coupled with the flange of the liner to couple the liner with the jacket.

In some embodiments, the jacket cap further includes a support lip that extends from the mount wall away from the flange. In some embodiments, the support lip is spaced apart from the side wall of the liner.

In some embodiments, the brim of the jacket cap includes an external wall, an internal wall, and a join wall. The external wall is exposed to the earth. The interior wall is spaced apart from the external wall and connected with the mount wall. The join wall extends between and interconnects the external wall and the interior wall. In some embodiments, the mount wall and the interior wall cooperate to define a groove that extends away from the join wall.

In some embodiments, the jacket includes a first end wall, a second end wall spaced apart from the first end wall, a first side wall extending between and interconnecting the first end wall and the second end wall, and a second side wall spaced apart from the first side wall and extending between and interconnecting the first end wall and the second end wall. The first end wall, the second end wall, the first side wall, and the second side wall are integrally formed as a one-piece, single component.

In some embodiments, the first end wall, the second end wall, the first side wall, and the second side wall define the perimeter edge of the jacket. The jacket cap is an integrally formed one-piece, single component that extends continuously around the perimeter edge of the jacket.

In some embodiments, the burial vault assembly includes a first layer of adhesive and a second layer of adhesive. The first layer of adhesive is located between the brim and the jacket to couple the jacket cap with the jacket. The second layer of adhesive is located between the mount wall and the flange to couple the liner with the jacket cap.

In some embodiments, the liner is an inner liner configured to receive a funerary box therein. The jacket is an outer jacket arranged around the inner liner.

In some embodiments, the liner is a jacket liner configured to extend over a funerary box. The jacket is a cover jacket arranged around the jacket liner.

According to another aspect of the disclosure, a method of making a burial vault assembly includes a number of steps. The method includes arranging a jacket cap around an edge of a jacket configured to be exposed to earth surrounding the burial vault assembly, coupling the jacket cap with the edge of the jacket, moving a liner into a cavity defined by the jacket such that a portion of the liner is supported by the jacket cap, and coupling the portion of the liner with the jacket cap.

These and other features of the present disclosure will become more apparent from the following description of the illustrative embodiments.

DETAILED DESCRIPTION OF THE DRAWINGS

Figure 1:
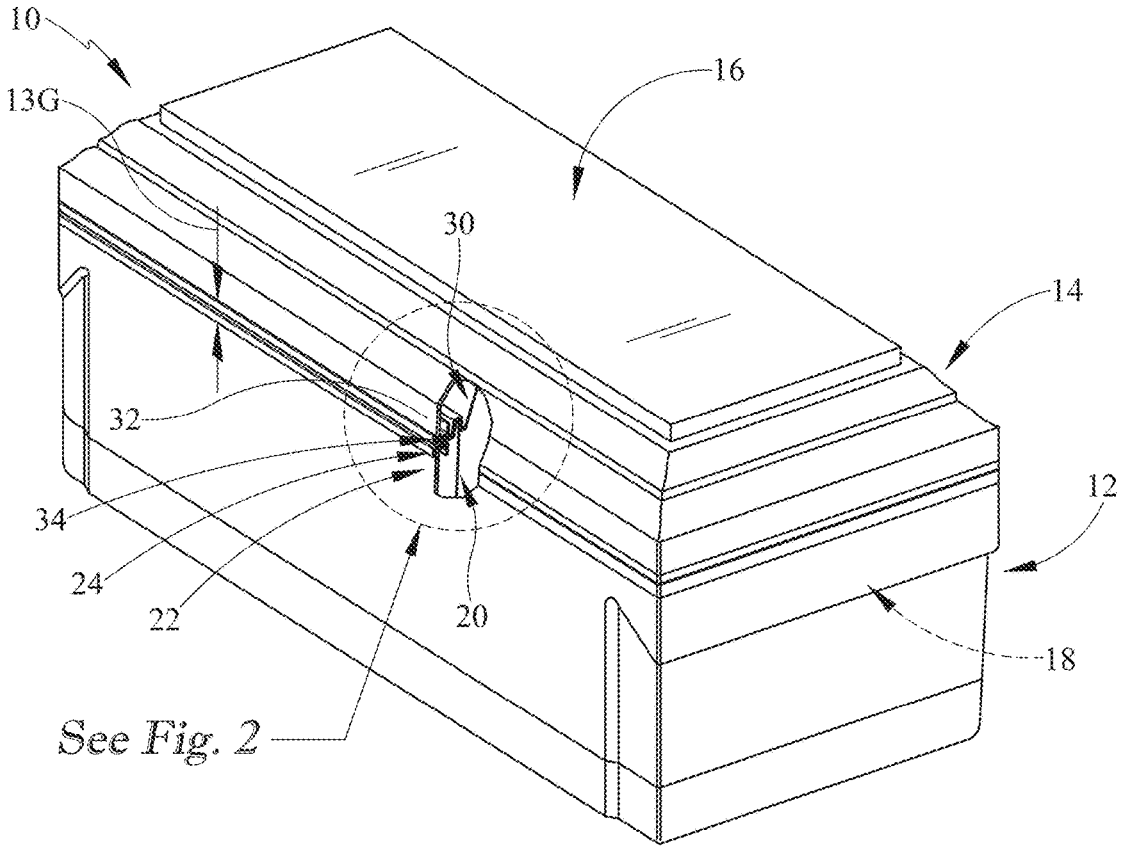
FIG. 1 is a perspective view of a burial vault assembly adapted to be arranged around a funerary box with a portion broken away to show the burial vault assembly includes a base formed to define an interior region adapted to receive the funerary box therein and a cover configured to be supported on the base to closed the interior region and block ingress of moisture and earth into the interior region.

For the purposes of promoting an understanding of the principles of the disclosure, reference will now be made to a number of illustrative embodiments illustrated in the drawings and specific language will be used to describe the same.

Figure 2:
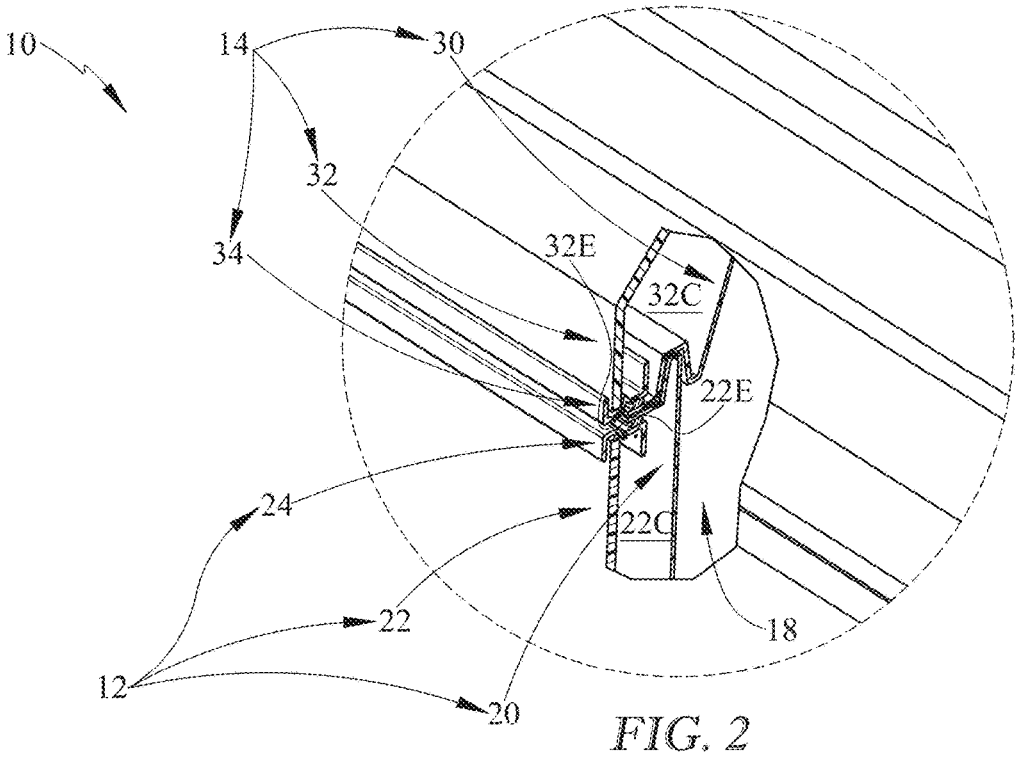
FIG. 2 is a detail view of FIG. 1 showing the base includes an inner liner, an outer jacket arranged around the inner liner that may be exposed to earth surrounding the burial vault assembly, and a base jacket cap that couples the inner liner with the outer jacket, and showing the cover includes a cover liner supported by the inner liner of the base to close access into the interior region, a cover jacket arranged around the cover liner that may be exposed to the earth, and a cover jacket cap that couples the cover liner to the cover jacket.
Figure 3:
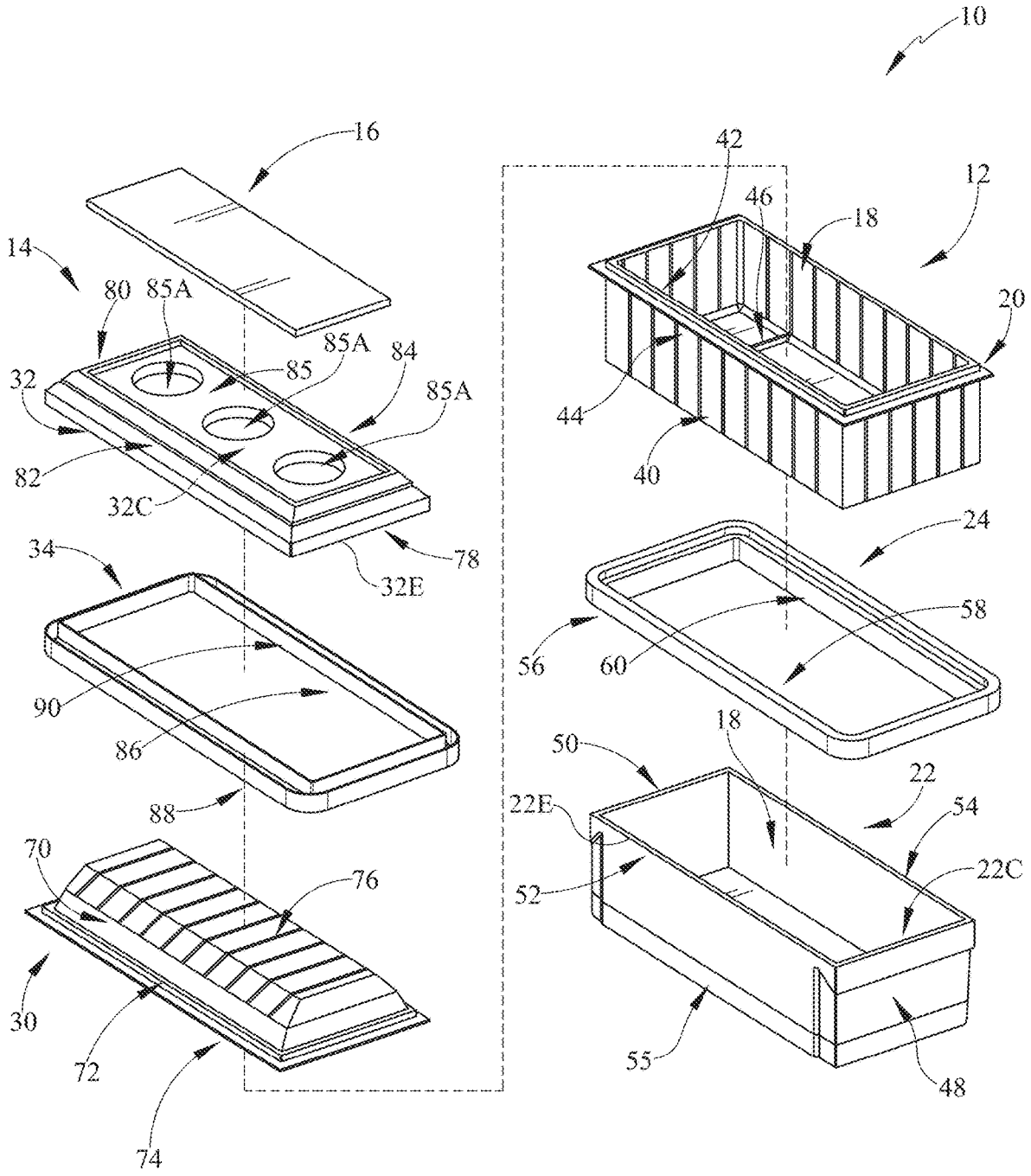
FIG. 3 is an exploded view of FIG. 1 showing the burial vault comprises, from top to bottom, the cover including a carapace, the cover jacket, the cover jacket cap, and the cover liner and the base including the inner liner, the base jacket cap, and the outer jacket.

An illustrative burial vault assembly 10 adapted to be arranged around a funerary box is shown in FIG. 1. The burial vault assembly 10 includes a base 12, a cover 14, and a carapace 16 as shown in FIGS. 1-3. The base 12 is formed to define an interior region 18 adapted to receive the funerary box therein. The cover 14 is configured to be supported on the base 12 to close the interior region 18 and block ingress of moisture and earth into the interior region 18. The carapace 16 is supported on the cover 14.

The base 12 includes an inner liner 20, an outer jacket 22, and a base jacket cap 24 as shown in FIGS. 1-3. The outer jacket 22 is arranged around the inner liner 20. The outer jacket 22 is configured to be exposed to earth surrounding the burial vault assembly 10. The base jacket cap 24 extends around a perimeter edge 22E of the outer jacket 22 and couples the inner liner 20 with the outer jacket 22.

The cover 14 includes a cover liner 30, a cover jacket 32, and a cover jacket cap 34 as shown in FIGS. 1-3. The cover liner 30 is supported by the inner liner 20 of the base 12 to close access into the interior region 18. The cover jacket 32 is arranged around the cover liner 30. The cover jacket 32 is configured to be exposed to the earth. The cover jacket cap 34 extends around a perimeter edge 32E of the cover jacket 32 and couples the cover liner 30 to the cover jacket 32.

The inner liner 20, the outer jacket 22, the base jacket cap 24, the cover liner 30, the cover jacket 32, and the cover jacket cap 34 are made of polymeric material in the illustrative embodiment. In some embodiments, at least the outer jacket 22, the base jacket cap 24, the cover jacket 32, and the cover jacket cap 34 are made of high-density polyethylene.

In some embodiments, the inner liner 20 and the cover liner 30 are further made of high-density polyethylene.

Figure 4:
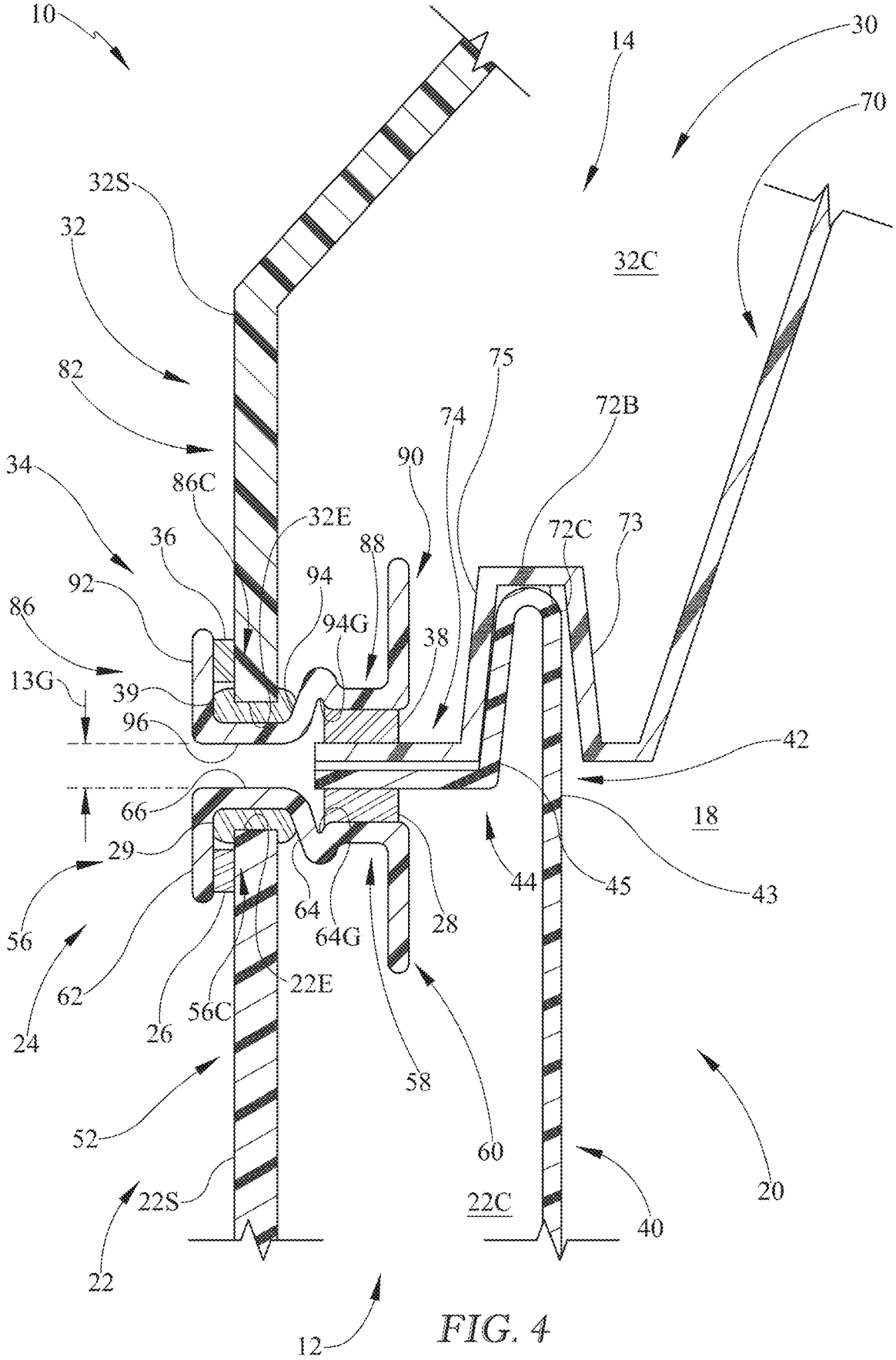
FIG. 4 is an enlarged section view of the burial vault assembly showing the base includes layers of adhesive between the base jacket cap, the outer jacket, and the inner liner to couple the components of the base together, the cover also includes layer of adhesive between the cover jacket cap, the cover jacket, and the cover liner to couple the components of the cover together, and both the base and cover include sealant between the respective jacket cap and jacket to seal therebetween, and further suggesting that the base and cover form hollow cavities adapted to be filled with concrete or other material.

Both the base jacket cap 24 and the cover jacket cap 34 couple the multiple components of the base 12 and cover 14 respectively. The base jacket cap 24 couples the inner liner 20 with the outer jacket 22. The cover jacket cap 34 couples the cover liner 30 to the cover jacket 32. When the cover 14 is supported on the base 12 to close the interior region 18 and block ingress of moisture and earth into the interior region 18, the inner liner 20 interlocks with the cover liner 30. The base jacket cap 24 is adjacent to the cover jacket cap 34 and, in the illustrative embodiment, forms a relatively small gap 13G therebetween as shown in FIG. 4. The base jacket cap 24 and the cover jacket cap 34 are substantially similar in the illustrative embodiment. This allows for a reduction in the number of different parts to be manufactured and may simplify assembly. In other embodiments, the base jacket cap 24 and the cover jacket cap 34 may have more substantial differences.

The cover cavity 32C formed between the cover liner 30 and the cover jacket 32 is then filled with cement before the carapace 16 is set on top of the cover 14. This prevents the cover 14 from being easily separated from the base 12. The gap 13G between the base 12 and the cover 14 may be used to separate the cover 14 from the base 12 using tools, such as a pry bar. However, the gap 13G is not large enough for someone to easily separate the cover 14 from the base 12. Moreover, the interlock between the inner liner 20 and the cover liner 30 blocks ingress of moisture and earth into the interior region 18.

Figure 6:
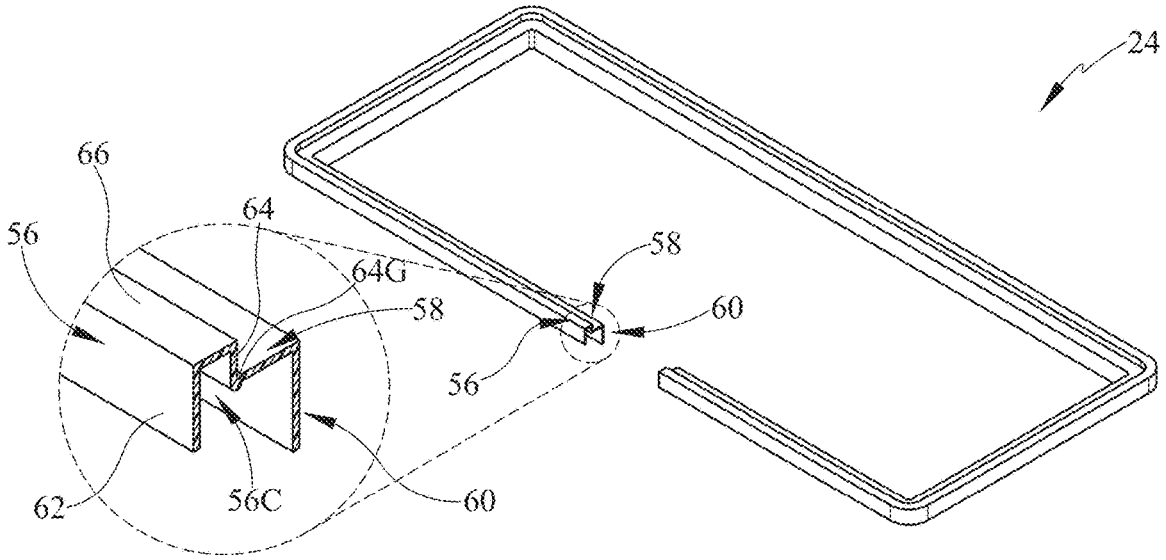
FIG. 6 is a perspective view of the base jacket cap included in the base of the burial vault assembly of FIG. 1 showing the base jacket cap, also referred to as the first jacket cap, includes a first brim that defines a jacket-receiving channel that receives at least a portion of the perimeter edge of the outer jacket therein and a first mount wall that extends away from the first brim toward the side wall of the inner liner and couples with the flange of the inner liner to couple the inner liner with the outer jacket.

The base jacket cap 24, or first jacket cap 24, includes a first brim 56 and a first mount wall 58 as shown in FIGS. 4 and 6. The first brim 56 defines a first jacket-receiving channel 56C that receives at least a portion of the perimeter edge 22E of the outer jacket 22 therein. The first mount wall 58 extends away from the first brim 56 toward the inner liner 20. The first mount wall 58 is coupled with the inner liner 20 to couple the inner liner 20 with the outer jacket 22.

The first brim 56 of the first jacket cap 24 includes an external wall 62, an interior wall 64, and a join wall 66 as shown in FIGS. 4 and 6. The external wall 62 is exposed to the earth surrounding the burial vault assembly 10. The interior wall 64 is spaced apart from the external wall 62 and connected with the first mount wall 58. The join wall 66 extends between and interconnects the external wall 62 and the interior wall 64. In the illustrative embodiment, the first mount wall 58 and the interior wall 64 cooperate to define a groove 64G that extends away from the join wall 66.

Figure 5:
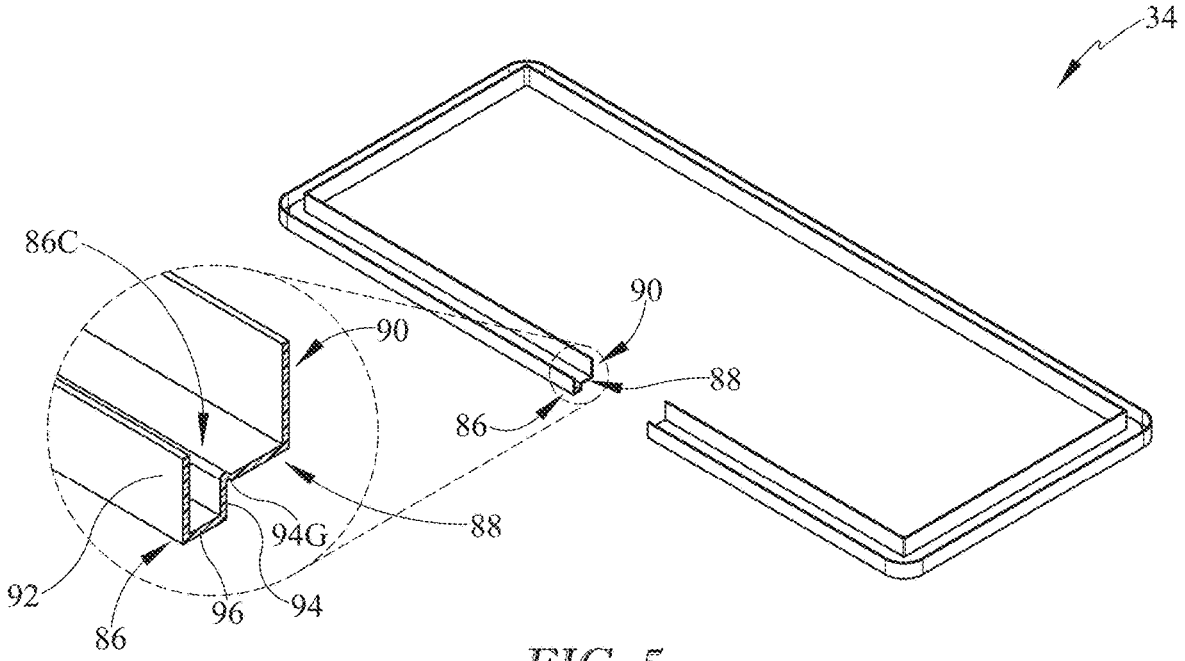
FIG. 5 is a perspective view of the cover jacket cap included in the cover of the burial vault assembly of FIG. 1 showing the cover jacket cap, also referred to as the second jacket cap, includes a second brim that defines a second jacket-receiving channel that receives at least a portion of the perimeter edge of the cover jacket therein and a second mount wall that extends away from the second brim toward the cover liner and couples with the cover liner to couple the cover liner with the cover jacket.

The cover jacket cap 34, or second jacket cap 34, includes a second brim 86 and a second mount wall 88 as shown in FIGS. 4 and 5. The second brim 86 defines a second jacket-receiving channel 86C that receives at least a portion of the perimeter edge 32E of the cover jacket 32 therein. The second mount wall 88 extends away from the second brim 86 toward the cover liner 30. The second mount wall 88 is coupled with the cover liner 30 to couple the cover liner 30 with the cover jacket 32.

The second brim 86 of the cover jacket cap 34 includes an external wall 92, and interior wall 94, and a join wall 96 as shown in FIGS. 4 and 5. The external wall 92 is exposed to the earth. The interior wall 94 is spaced apart from the external wall 92 and connected with the second mount wall 88. The join wall 96 extends between and interconnects the external wall 92 and the interior wall 94. In the illustrative embodiment, the second mount wall 88 and the interior wall 94 cooperate to define a groove 94G that extends away from the join wall 96.

In the illustrative embodiment, both the base 12 and the cover 14 include layers of adhesive 26, 28, 36, 38 and sealant 29, 39 as shown in FIG. 4. The base 12 includes layers of adhesive 26, 28 between the base jacket cap 24, the outer jacket 22, and the inner liner 20 to couple the components of the base 12 together. The cover 14 includes layer of adhesive 36, 38 between the cover jacket cap 34, the cover jacket 32, and the cover liner 30 to couple the components of the cover 14 together. The sealant 29 is located between the outer jacket 22 and the base jacket cap 24 to seal therebetween, while the sealant 39 is located between the cover jacket 32 and the cover jacket cap 34 to seal therebetween.

The base 12 includes a first layer of adhesive 26 between the base jacket cap 24 and the outer jacket 22 to couple the base jacket cap 24 with the outer jacket 22 and a second layer of adhesive 28 between the base jacket cap 24 and the inner liner 20 to couple the inner liner 20 with the base jacket cap 24. The sealant 29 is located between the base jacket cap 24 and the outer jacket 22 to seal therebetween.

The cover 14 includes a first layer of adhesive 36 between the cover jacket cap 34 and the cover jacket 32 to couple the cover jacket cap 34 with the cover jacket 32 and a second layer of adhesive 38 between the cover jacket cap 34 and the cover liner 30 to couple the cover liner 30 with the cover jacket cap 34. The sealant 39 is located between the cover jacket cap 34 and the cover jacket 32 to seal therebetween.

Turning again to the base 12, the inner liner 20 is formed to include an inner liner side wall 40, an inner liner rim 42, an inner liner flange 44, and an inner liner floor 46 as shown in FIG. 4. The inner liner side wall 40 is formed to define the interior region 18. The inner liner rim 42 extends upwardly from the inner liner side wall 40. The inner liner flange 44 extends from the inner liner rim 42 away from interior region 18 of the inner liner side wall 40. The inner liner floor 46 is coupled to the inner liner side wall 40 to close an end of the interior region 18. In the illustrative embodiment, the inner liner 20 is a single, integral, one-piece component.

The inner liner rim 42 has a first section 43, a second section 45, and a bend section 42B as shown in FIG. 4. The first section 43 extends upwardly from the inner liner side wall 40. The second section 45 extends relatively parallel with the first section 43 adjacent to the first section 43. The bend section 42B extends between and interconnects the first and second sections 43, 45. The bend section 42B is spaced apart from the inner liner flange 44.

The outer jacket 22 includes a first end wall 48, a second end wall 50, a first side wall 52, a second side wall 54, and a floor 55 as shown in FIGS. 3 and 4. The second end wall 50 is spaced apart from the first end wall 48. The first side wall 52 extends between and interconnects the first end wall 48 and the second end wall 50. The second side wall 54 is spaced apart from the first side wall 52. The second side wall 54 extends between and interconnects the first end wall 48 and the second end wall 50. The floor 55 is coupled to the first end wall 48, the second end wall 50, the first side wall 52, the second side wall 54 to close an end of a base cavity 22C defined by the first end wall 48, the second end wall 50, the first side wall 52, the second side wall 54.

In the illustrative embodiment, the first end wall 48, the second end wall 50, the first side wall 52, and the second side wall 54 are integrally formed as a one-piece, single component. In other embodiments, the first end wall 48, the second end wall 50, the first side wall 52, and the second side wall 54 are separate pieces assembled together.

The first end wall 48, the second end wall 50, the first side wall 52, the second side wall 54 define an entirety of the perimeter edge 22E of the outer jacket 22 as shown in FIG. 3. In the illustrative embodiment, the first jacket cap 24 is an integral one-piece, single component that extends continuously around the entirety of the perimeter edge 22E of the outer jacket 22 as suggested in FIG. 3.

In the illustrative embodiment, the bend section 42B of the inner liner rim 42 is spaced apart from the edge 22E of the outer jacket 22 as shown in FIG. 4. The bend section 42B extends past the perimeter edge 22E of the outer jacket 22 when the inner liner 20 is located in the base cavity 22C of the outer jacket 22.

The base jacket cap 24, or first jacket cap 24, includes the first brim 56, the first mount wall 58, and a first support lip 60 as shown in FIGS. 4 and 6. The first brim 56 defines the first jacket-receiving channel 56C that receives at least a portion of the perimeter edge of the outer jacket 22 therein. The first mount wall 58 extends away from the first brim 56 toward the inner liner side wall 40 of the inner liner 20. The first mount wall 58 is coupled with the inner liner flange 44 of the inner liner 20 to couple the inner liner 20 with the outer jacket 22. The first support lip 60 extends away from the first mount wall 58 and the cover 14 and toward the floor 55 of the outer jacket 22 to reinforce a strength of the first jacket cap 24.

In the illustrative embodiment, the first support lip 60 is spaced apart from the inner liner side wall 40 of the inner liner 20. In other embodiments, the first support lip 60 may abut the inner liner side wall 40 of the inner liner 20.

The first brim 56 of the first jacket cap 24 includes the external wall 62, the interior wall 64, and the join wall 66 as shown in FIGS. 4 and 6. The external wall 62 is exposed to the earth surrounding the burial vault assembly 10. The interior wall 64 is spaced apart from the external wall 62 and connected with the first mount wall 58. The join wall 66 extends between and interconnects the external wall 62 and the interior wall 64. In the illustrative embodiment, the first mount wall 58 and the interior wall 64 cooperate to define the groove 64G that extends away from the join wall 66.

The first layer of adhesive 26 is located between the external wall 62 included in the first brim 56 of the first jacket cap 24 and outer jacket 22 as shown in FIG. 4. The second layer of adhesive 28 is located between first mount wall 58 of the first jacket cap 24 and the inner liner flange 44 of the inner liner 20 as shown in FIG. 4.

Both the first and second layers of adhesive 26, 28 extend around the perimeter of the inner liner 20 and the outer jacket 22 in the illustrative embodiment. In other embodiments, the first and second layers of adhesive 26, 28 may be segmented around the perimeter of the inner liner 20 and the outer jacket 22.

The sealant 29 is located in the first jacket-receiving channel 56C as shown in FIG. 4. The sealant 29 is located between the join wall 66 included in the first brim 56 of the first jacket cap 24 and the perimeter edge 22E of the outer jacket 22. The sealant 29 extends around the perimeter edge 22E of the outer jacket 22 formed by the first end wall 48, the second end wall 50, the first side wall 52, and the second side wall 54.

Turning again to the cover 14, the cover liner 30 includes a cover liner side wall 70, a cover liner rim 72, a cover liner flange 74, and a cover liner lid 76 as shown in FIG. 4. The cover liner side wall 70 is formed to define a portion of the interior region 18. The cover liner rim 72 extends upwardly from the cover liner side wall 70. The cover liner flange 74 extends from the cover liner rim 72 away from interior region 18 of the cover liner side wall 70. The cover liner lid 76 is coupled to the cover liner side wall 70 to close an end of the interior region 18.

The cover liner rim 72 is formed to include a rim-receiving channel 72C as shown in FIG. 4. The inner liner rim 42 is located in the rim-receiving channel 72C when the cover 14 is assembled on the base 12 to form the interlock between the base 12 and the cover 14.

The cover liner rim 72 has a first section 73, a second section 75, and a bend section 72B as shown in FIG. 4. The first section 73 extends upwardly from the cover liner side wall 70. The second section 75 extends upwardly from the cover liner flange 74. The second section 75 is spaced apart from the first section 73 to define the rim-receiving channel 72C. The bend section 72B extends between and interconnects the first and second sections 73, 75 to form an end of the rim-receiving channel 72C.

The cover jacket 32 includes a first end wall 78, a second end wall 80, a first side wall 82, a second side wall 84, and a lid 85 as shown in FIGS. 3 and 4. The second end wall 80 is spaced apart from the first end wall 78. The first side wall 82 extends between and interconnects the first end wall 78 and the second end wall 80. The second side wall 84 is spaced apart from the first side wall 82. The second side wall 84 extends between and interconnects the first end wall 78 and the second end wall 80. The lid 85 is coupled to the first end wall 78, the second end wall 80, the first side wall 82, the second side wall 84 to close an end of a cover cavity 32C defined by the first end wall 78, the second end wall 80, the first side wall 82, the second side wall 84.

In the illustrative embodiment, the first end wall 78, the second end wall 80, the first side wall 82, and the second side wall 84 are integrally formed as a one-piece, single component. In other embodiments, the first end wall 78, the second end wall 80, the first side wall 82, and the second side wall 84 are separate pieces assembled together.

The first end wall 78, the second end wall 80, the first side wall 82, the second side wall 84 define an entirety of the perimeter edge 32E of the cover jacket 32 as shown in FIG. 3. The second jacket cap 34 is an integral one-piece, single component that extends continuously around the entirety of the perimeter edge 32E of the cover jacket 32.

The lid 85 is formed to include apertures 85A that open into the cover cavity 32C as shown in FIG. 3. The apertures 85A allow cement to be poured into the cover cavity 32C formed between the cover jacket 32 and the cover liner 30 as shown in FIG. 4. The carapace 16 is located on top of the lid 85 of the cover jacket 32 to cover the apertures 85A.

The cover jacket cap 34, or second jacket cap 34, includes the second brim 86, the second mount wall 88, and a second support lip 90 as shown in FIGS. 4 and 5. The second brim 86 defines a second jacket-receiving channel 86C that receives at least a portion of the perimeter edge 32E of the cover jacket 32 therein. The second mount wall 88 extends away from the second brim 86 toward the cover liner 30. The second mount wall 88 is coupled with the cover liner 30 to couple the cover liner 30 with the cover jacket 32. The second support lip 90 extends away from the second mount wall 88 and the base 12 and toward a lid of the cover jacket 32 to reinforce a strength of the second jacket cap 34.

The second brim 86 of the cover jacket cap 34 includes an external wall 92, and interior wall 94, and a join wall 96 as shown in FIGS. 4 and 5. The external wall 92 is exposed to the earth. The interior wall 94 is spaced apart from the external wall 92 and connected with the second mount wall 88. The join wall 96 extends between and interconnects the external wall 92 and the interior wall 94. In the illustrative embodiment, the second mount wall 88 and the interior wall 94 cooperate to define a groove 94G that extends away from the join wall 96.

The first layer of adhesive 36 is located between the external wall 92 included in the second brim 86 of the second jacket cap 34 and cover jacket 32 as shown in FIG. 4. The second layer of adhesive 38 is located between second mount wall 88 of the second jacket cap 34 and the cover liner flange 74 of the cover liner 30 as shown in FIG. 4.

Both the first and second layers of adhesive 36, 38 extend around the perimeter of the cover liner 30 and the cover jacket 32 in the illustrative embodiment. In other embodiments, the first and second layers of adhesive 36, 38 may be segmented around the perimeter of the cover liner 30 and the cover jacket 32.

The sealant 39 is located in the second jacket-receiving channel 86C as shown in FIG. 4. The sealant 39 is located between the join wall 96 included in the second brim 86 of the second jacket cap 34 and the perimeter edge 32E of the cover jacket 32. The sealant 39 extends around the perimeter edge 32E of the cover jacket 32 formed by the first end wall 78, the second end wall 80, the first side wall 82, and the second side wall 84.

A method of making the burial vault assembly 10 may include several steps. The method may first include assembling the base 12 or the cover 14. To assemble the base 12, the method includes arranging the first jacket cap 24 around the perimeter edge 22E of the outer jacket 22 and coupling the first jacket cap 24 to the edge 22E of the outer jacket 22.

To arrange the first jacket cap 24 around the perimeter edge 22E of the outer jacket 22, the method includes arranging the sealant 29 in the first jacket-receiving channel 56C of the first jacket cap 24 and arranging the first layer of adhesive 26 on the external wall 62 of the first jacket cap 24. Then, the perimeter edge 22E formed by the first end wall 48, the second end wall 50, the first side wall 52, and the second side wall 54 of the outer jacket 22 is inserted into the first jacket-receiving channel 56C so that the perimeter edge 22E engages the sealant 29. To couple the first jacket cap 24 to the edge 22E of the outer jacket 22, the method includes engaging the first layer of adhesive 26 on the external wall 62 to an outer surface 22S of the outer jacket 22. The sealant 29 may also help to couple the first jacket cap 24 to the edge 22E of the outer jacket 22.

Next, the inner liner 20 is moved into the base cavity 22C defined by the outer jacket 22 such that a portion of the inner liner 20 is supported by the first jacket cap 24. In other words, the inner liner 20 is moved into the base cavity 22C so that the inner liner flange 44 engages the first mount wall 58 of the first jacket cap 24.

The method includes coupling the inner liner 20 to the first jacket cap 24. To couple the inner liner 20 to the first jacket cap 24, the method includes arranging the second layer of adhesive 28 on the first mount wall 58 of the first jacket cap 24. The second layer of adhesive 28 may be arranged on the first mount wall 58 of the first jacket cap 24 before the inner liner 20 is moved into the base cavity 22C and coupling the inner liner 20 to the first jacket cap 24 includes engaging the inner liner flange 44 with the second layer of adhesive 28 on the first jacket cap 24.

Similar steps are used to assembly the cover 14. To assemble the cover 14, the method includes arranging the second jacket cap 34 around the perimeter edge 32E of the cover jacket 32 and coupling the second jacket cap 34 to the edge 32E of the cover jacket 32.

To arrange the second jacket cap 34 around the perimeter edge 32E of the cover jacket 32, the method includes arranging the sealant 39 in the second jacket-receiving channel 86C of the second jacket cap 34 and arranging the first layer of adhesive 36 on the external wall 92 of the second jacket cap 34. Then, the perimeter edge 32E formed by the first end wall 78, the second end wall 80, the first side wall 82, and the second side wall 84 of the cover jacket 32 is inserted into the second jacket-receiving channel 86C so that the perimeter edge 32E engages the sealant 39. To couple the second jacket cap 34 to the edge 32E of the cover jacket 32, the method includes engaging the first layer of adhesive 36 on the external wall 92 to an outer surface 32S of the cover jacket 32. The sealant 39 may also help to couple the second jacket cap 34 to the edge 32E of the cover jacket 32.

Next, the cover liner 30 is moved into the cover cavity 32C defined by the cover jacket 32 such that a portion of the cover liner 30 is supported by the second jacket cap 34. In other words, the cover liner 30 is moved into the cover cavity 32C so that the cover liner flange 74 engages the second mount wall 88 of the second jacket cap 34.

The method includes coupling the cover liner 30 to the second jacket cap 34. To couple the cover liner 30 to the second jacket cap 34, the method includes arranging the second layer of adhesive 38 on the second mount wall 88 of the second jacket cap 34. The second layer of adhesive 38 may be arranged on the second mount wall 88 of the second jacket cap 34 before the cover liner 30 is moved into the cover cavity 32C and coupling the cover liner 30 to the second jacket cap 34 includes engaging the cover liner flange 74 with the second layer of adhesive 38 on the second jacket cap 34.

Once both the base 12 and the cover 14 are each assembled, the base 12 and the cover 14 may be assembled together. To assemble the cover 14 on the base 12, the cover 14 is moved over the base 12 so that the rim-receiving channel 72C is aligned with the inner liner rim 42 and lowered so that the inner liner rim 42 is inserted into the rim-receiving channel 72C. In this way, the inner liner 20 is interlocked with the cover liner 30. In some embodiments, the base 12 and the cover 14 are formed separately and then assembled together. In other embodiments, the base 12 may be formed first and the cover 14 assembled onto the base 12. Once the cover 14 is supported on the base 12, cement may be added to the cover cavity 32C. The cement is poured into the cover cavity 32C and is poured into a bottom of the outer jacket 22.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A burial vault assembly adapted to be arranged around a funerary box, the burial vault assembly comprising:

a base formed to define an interior region adapted to receive the funerary box therein, the base including an inner liner, an outer jacket, and a first jacket cap, the inner liner having a side wall formed to define the interior region, a rim that extends upwardly from the side wall, and a flange that extends from the rim away from the interior region of the side wall, the outer jacket being arranged around the inner liner and configured to be exposed to earth surrounding the burial vault assembly, and the first jacket cap extends around a perimeter edge of the outer jacket, wherein the first jacket cap includes a first brim and a first mount wall, the first brim defines a jacket-receiving channel that receives at least a portion of the perimeter edge of the outer jacket therein, and the first mount wall extends away from the first brim toward the side wall of the inner liner and is coupled with the flange of the inner liner to couple the inner liner with the outer jacket, and a cover configured to be supported on the base to close the interior region and block ingress of moisture and the earth into the interior region, the cover including a cover liner supported by the inner liner of the base to close access into the interior region, a cover jacket arranged around the cover liner and configured to be exposed to the earth, and a second jacket cap that extends around a perimeter edge of the cover jacket, wherein the second jacket cap includes a second brim and a second mount wall, the second brim defines a second jacket-receiving channel that receives at least a portion of the perimeter edge of the cover jacket therein, and the second mount wall extends away from the second brim toward the cover liner and is coupled with the cover liner to couple the cover liner with the cover jacket.

2. The burial vault assembly of claim 1, wherein the first jacket cap further includes a first support lip that extends away from the first mount wall and the cover and toward a floor of the outer jacket to reinforce a strength of the first jacket cap.

3. The burial vault assembly of claim 2, wherein the first support lip is spaced apart from the side wall of the inner liner.

4. The burial vault assembly of claim 1, wherein the first brim of the first jacket cap includes an external wall that is exposed to the earth surrounding the burial vault assembly, an interior wall spaced apart from the external wall and connected with the first mount wall, and a join wall that extends between and interconnects the external wall and the interior wall.

5. The burial vault assembly of claim 4, wherein the first mount wall and the interior wall cooperate to define a groove that extends away from the join wall.

6. The burial vault assembly of claim 1, wherein the outer jacket includes a first end wall, a second end wall spaced apart from the first end wall, a first side wall extending between and interconnecting the first end wall and the second end wall, and a second side wall spaced apart from the first side wall and extending between and interconnecting the first end wall and the second end wall and wherein the first end wall, the second end wall, the first side wall, and the second side wall are integrally formed as a one-piece, single component.

7. The burial vault assembly of claim 6, wherein the first end wall, the second end wall, the first side wall, the second side wall define an entirety of the perimeter edge of the outer jacket and the first jacket cap is an integral one-piece, single component that extends continuously around the entirety of the perimeter of the outer jacket.

8. The burial vault assembly of claim 6, wherein the inner liner includes a floor coupled with the side wall to close an end of the interior region, the outer jacket includes a floor extending between and interconnecting the first end wall, the second end wall, the first side wall, and the second side wall, and the floor of the inner liner is supported by the floor of the outer jacket.

9. The burial vault assembly of claim 1, further comprising a first layer of adhesive located between the first brim and the outer jacket to couple the first jacket cap with the outer jacket and a second layer of adhesive located between the first mount wall and the flange to couple the inner liner with the first jacket cap.

10. A burial vault assembly comprising:

a liner having a side wall formed to define an interior region, a rim that extends from the side wall, and a flange that extends from the rim away from the interior region of the side wall, a jacket arranged around the liner and configured to be exposed to earth surrounding the burial vault assembly, and a jacket cap that includes a brim and a mount wall, the brim defines a jacket-receiving channel that receives at least a portion of a perimeter edge of the jacket therein, and the mount wall extends away from the brim toward the side wall of the liner and is coupled with the flange of the liner to couple the liner with the jacket.

11. The burial vault assembly of claim 10, wherein the jacket cap further includes a support lip that extends from the mount wall away from the flange.

12. The burial vault assembly of claim 11, wherein the support lip is spaced apart from the side wall of the liner.

13. The burial vault assembly of claim 10, wherein the brim of the jacket cap includes an external wall that is exposed to the earth, an interior wall spaced apart from the external wall and connected with the mount wall, and a join wall that extends between and interconnects the external wall and the interior wall.

14. The burial vault assembly of claim 13, wherein the mount wall and the interior wall cooperate to define a groove that extends away from the join wall.

15. The burial vault assembly of claim 10, wherein the jacket includes a first end wall, a second end wall spaced apart from the first end wall, a first side wall extending between and interconnecting the first end wall and the second end wall, and a second side wall spaced apart from the first side wall and extending between and interconnecting the first end wall and the second end wall and wherein the first end wall, the second end wall, the first side wall, and the second side wall are integrally formed as a one-piece, single component.

16. The burial vault assembly of claim 15, wherein the first end wall, the second end wall, the first side wall, and the second side wall define the perimeter edge of the jacket and the jacket cap is an integrally formed one-piece, single component that extends continuously around the perimeter edge of the jacket.

17. The burial vault assembly of claim 15, further comprising a first layer of adhesive located between the brim and the jacket to couple the jacket cap with the jacket and a second layer of adhesive located between the mount wall and the flange to couple the liner with the jacket cap.

18. The burial vault assembly of claim 10, wherein the liner is an inner liner configured to receive a funerary box therein and the jacket is an outer jacket arranged around the inner liner.

19. The burial vault assembly of claim 10, wherein the liner is a jacket liner configured to extend over a funerary box and the jacket is a cover jacket arranged around the jacket liner.

* * * * *